US007031478B2

(12) United States Patent
Belt et al.

(10) Patent No.: US 7,031,478 B2
(45) Date of Patent: Apr. 18, 2006

(54) METHOD FOR NOISE SUPPRESSION IN AN ADAPTIVE BEAMFORMER

(75) Inventors: Harm Jan Willem Belt, Eindhoven (NL); Cornelis Pieter Janse, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 889 days.

(21) Appl. No.: 09/862,285

(22) Filed: May 22, 2001

(65) Prior Publication Data

US 2002/0013695 A1 Jan. 31, 2002

(30) Foreign Application Priority Data

May 26, 2000 (EP) ..... 00201879

(51) Int. Cl.
*H04R 3/00* (2006.01)

(52) U.S. Cl. ..... 381/92; 381/94.1; 381/94.3

(58) Field of Classification Search ..... 381/92, 381/94.1, 94.2, 94.3; 367/119; 704/226, 704/23, 3

See application file for complete search history.

(56) References Cited

U.S. PATENT DOCUMENTS

| | | | | |
|---|---|---|---|---|
| 5,574,824 | A | 11/1996 | Slyh et al. | 395/235 |
| 5,602,962 | A | 2/1997 | Kellermann | 395/2.35 |
| 6,339,758 | B1 * | 1/2002 | Kanazawa et al. | 704/226 |

OTHER PUBLICATIONS

J. Meyer et al; "Multi-Channel Speech Enchancement in a Car Environment Using Wiener Filtering and Spectral Subtraction" 1997 IEEE International Conference on Acoustics, Speech, and Signal Processing. Speech Processing, Munich, Apr. 21-24, 1997, IEEE International Conference on Acoustics, Speech, and Signal Processing (ICASSP), Los Alamitos, IEEE Comp. Soc. Press, US, vol. 2, pp. 1167-1170, XP000822660.

* cited by examiner

*Primary Examiner*—Brian T. Pendleton
(74) *Attorney, Agent, or Firm*—Larry Liberchuk

(57) ABSTRACT

A method for noise suppression is described, wherein noisy input signals in a multiple input audio processing device are subjected to adaptations and summed and wherein the noise frequency components of the noisy input signals in the summed input signals are estimated based on individually kept noise frequency components and on said adaptations. Advantageously the method may be applied if a spectral subtraction like technique is applied in a multi input beamformer. Only one spectral frequency transformation is necessary, which reduces the number of necessary calculations.

7 Claims, 2 Drawing Sheets

METHOD FOR NOISE SUPPRESSION IN AN ADAPTIVE BEAMFORMER

The present invention relates to a method for noise suppression, wherein noisy input signals in a multiple input audio processing device are subjected to adaptations and summed.

The present invention also relates to an audio processing device comprising multiple noisy inputs, an adaptation device coupled to the multiple noisy inputs, a summing device coupled to the adaptation device and an audio processor; and to a communication device having an audio processing device.

Such a method and device are known from U.S. Pat. No. 5,602,962. The known device is a speech processing arrangement having two or more inputs connected to microphones and a summing device for summing the processed input signals. The digitized input signals supply a combination of speech and noise signals to an adaptation device in the form of controllable multipliers, which provide a weighting with respective weight factors. An evaluation processor evaluates the microphone input signals and constantly adapts the weight factors or frequency domain coefficients for increasing the signal to noise ratio of the summed signal. For the case of a time variant and not stationary noise signal statistic, where noise standard deviations are not approximately time independent the respective weight factors are constantly recomputed and reset, where after their effect on the input signals is calculated and the summed signal computed. This alone leads to a very considerably number of calculations to be made by the evaluation processor. In particular in case Fast Fourier Transform (FFT) calculations are made for each input signal—wherein in addition the spectrum range of each input signal is subdivided in several sections, each section generally containing a complex number having a real part and an imaginary part, both to be calculated separately—the number of necessary real time calculations rises enormously. This puts the wanted calculation power of present days low cost processors beyond their feasible limits.

Therefore it is an object of the present invention to provide a method, an audio processing device and a communication device capable of performing noise evaluation in a multiple input device without excessive amounts of calculations and high speed processing being necessary therefor.

Thereto the method according to the invention is characterized in that noise frequency components of the noisy input signals in the summed input signals are estimated based on individually kept noise frequency components and on said adaptations.

Accordingly the audio processing device according to the invention is characterized in that the audio processor which is coupled to the adaptation device and the summing device is equipped to estimate individual noise frequency components of the noisy input signals.

It is an advantage of the method and audio processing device according to the present invention that the number of simultaneously necessary calculations can be reduced, since from the summing output signal and the individual adaptations the noise frequency components of all the noisy input signals can be estimated. This technique combines adaptive, so called beamforming with individualized noise determination, and is in particular meant for noise suppression applications in audio processing devices or communication devices and systems. Applications can now with reduced calculating power requirements more easily be implemented anywhere where noisy and reverberant speech is enhanced using multiple audio signals or microphones. Examples are found in audio broadcast systems, audio- and/or video conferencing systems, speech enhancement, such as in telephone, like mobile telephone systems, and speech recognition systems, speaker authentication systems, speech coders and the like.

Advantageously another embodiment of the method according to the invention is characterized in that the adaptations concern filtering or weighting of the noisy input signals.

When the adaptations concern filtering the noisy inputs are filtered, such as with Finite Impulse Response (FIR) filters. In that case one speaks of a Filtered Sum Beamformer (FSB), whereas in a Weighted Sum Beamformer (WSB) the filters are replaced by real gains or attenuations.

A further embodiment of the method according to the invention is characterized in that each estimated noise frequency component is related to a previous estimate of said noise frequency component and to a correction term which is dependent on the adaptations made on the noisy input signals.

Advantageously for every input signal separately the latest estimate of a respective input noise component in a frequency section or bin of the frequency spectrum is temporarily stored for later use by a recursion update relation to reveal an updated and accurately available noise component.

A still further embodiment of the method according to the invention is characterized in that the estimation of the noise frequency components of the respective input signals in the summed input signals can be made dependent on detection of an audio signal in the relevant input signal.

In this embodiment the estimation is made dependent on the detection of an audio signal, such as a speech signal. If speech is detected the estimation of noise frequency components is based on the previous not updated noise frequency component. If no speech is detected and only noise is present in the relevant input signal the estimation of the noise frequency components is based on an updated previous noise frequency component.

A following embodiment of the method according to the invention is characterized in that the method uses spectral subtraction like techniques to suppress noise.

Spectral subtracting is preferably used in case noise reduction is contemplated, such as in speech related applications.

At present the method, audio processing device and communication device according to the invention will be elucidated further together with their additional advantages while reference is being made to the appended drawing, wherein similar components are being referred to by means of the same reference numerals. In the drawing.

Figure 3A:
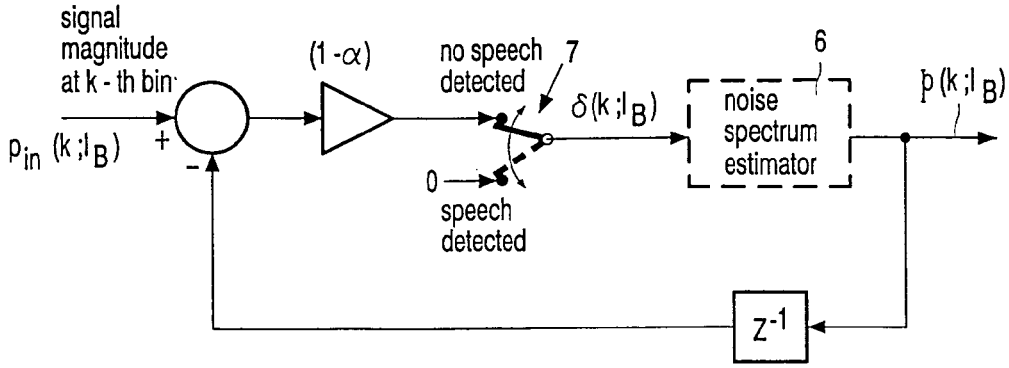
Figure 3B:
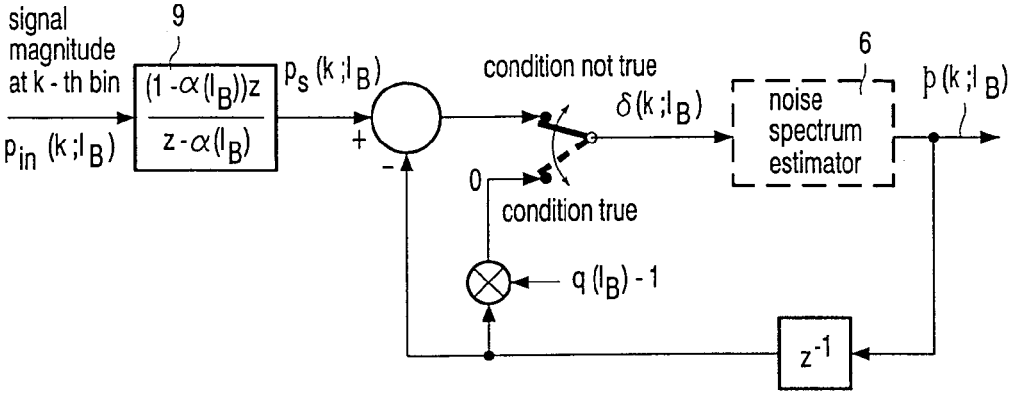
Figure 4:
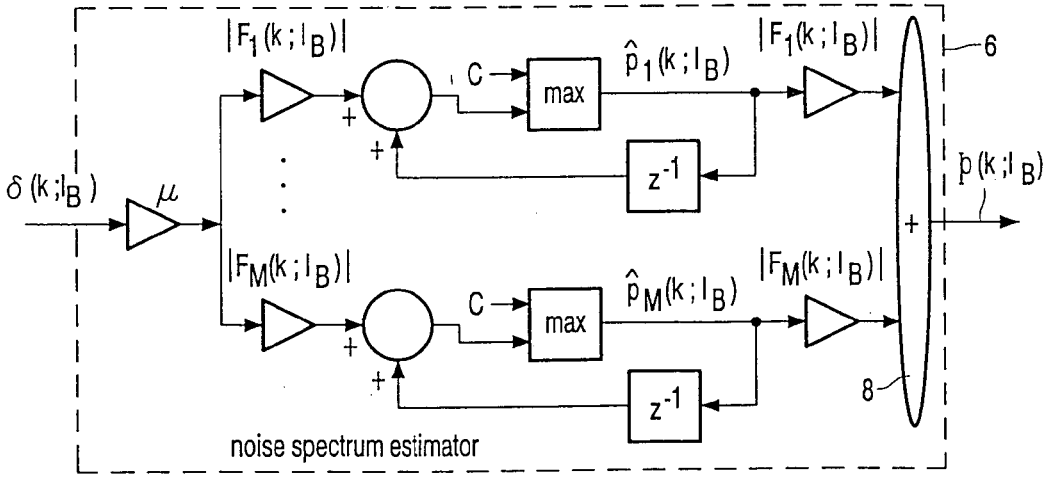

FIGS. 3*a* and 3*b* show noise estimator diagrams to be implemented in the audio processor for application in the audio processing device according to the invention, with and without speech detection respectively; and FIG. 4 shows an embodiment of a noise spectrum estimator for application in the respective diagrams of FIGS. 3*a* and 3*b*.

Figure 1:
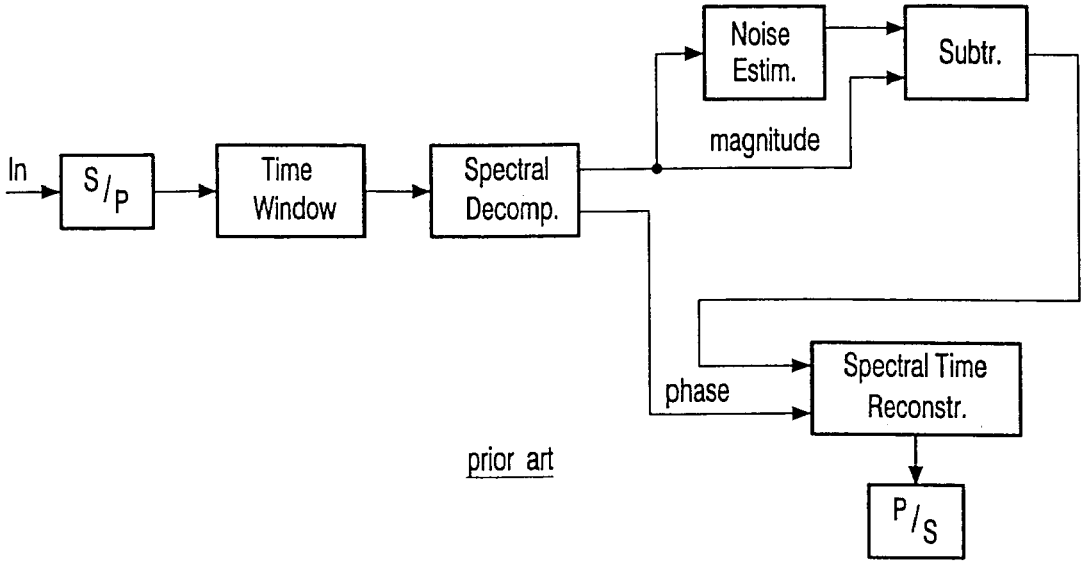
FIG. 1 shows a known diagram for elucidating the method and audio processing device according to the invention for applying noise suppression.

FIG. 1 shows a diagram for elucidating noise suppression by means of spectral subtraction. Digitized noisy input data at IN is at first converted from serial data to parallel data in a converter S/P, windowed in a Time Window and thereafter decomposed by a spectral transformation, such as a Discrete Fourier Transform (DFT). After the Spectral Time Decomposition the unaltered phase information is fed to a Spectral Reconstructer to apply an inverse DFT and then converted from parallel to serial data in converter P/S. Magnitude information is input to a Noise Estimator 1. A Subtractor or more general a Gain function receives a noise estimator output signal, which is representative for the estimated noise in the input signal IN, together with the magnitude information signal, which represents the magnitude of the frequency components of the noisy input signal IN. Both are spectrally subtracted to reveal a noise corrected magnitude information signal to be applied to the Spectral Time Reconstructer. The above spectral subtraction technique can be applied to an input signal for suppressing stationary noise therein. That is noise whose statistics do not substantially change as a function of time. There are many spectral subtraction like techniques. Known techniques can be found in the article: Speech Enhancement Based on A Priori Signal to Noise Estimation, IEEE ICASSP-96, pp 629–632 by P. Scalart and J. V. Filho.

Figure 2:
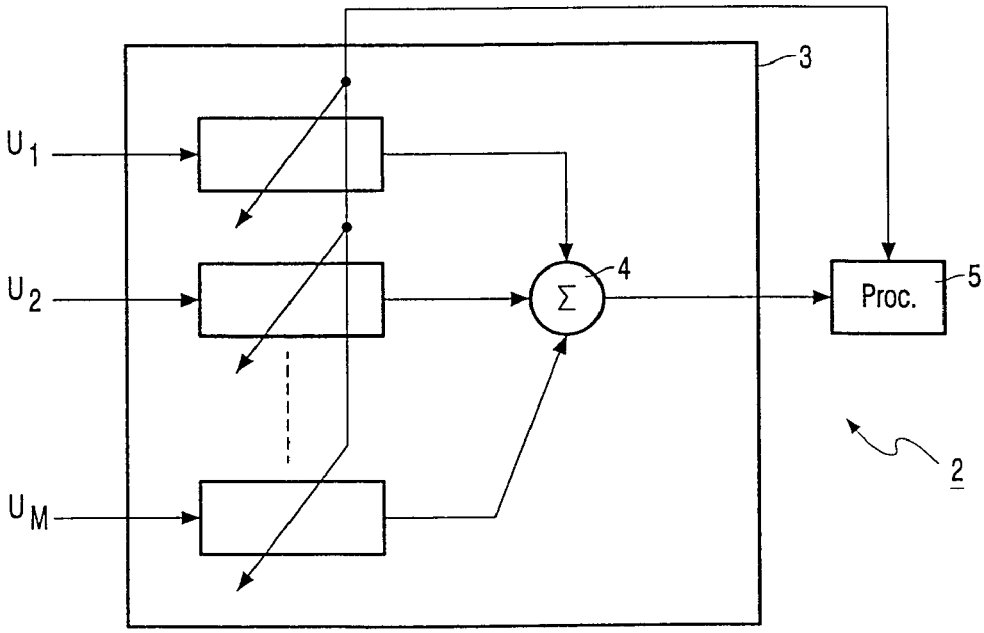
FIG. 2 shows a so called beamformer for application in the audio processing device according to the invention.

FIG. 2 shows a so called beamformer input part for application in an audio processing device 2. The audio processing device 2 comprising multiple noisy inputs $u_1$, $u_2$, . . . $u_M$, and an adaptation device 3 coupled to the multiple noisy inputs $u_1$, $U_2$, . . . $u_M$. A summing device 4 of the adaptation device 3 sums the adapted noisy inputs and is coupled to an audio processor 5 implementing the general noise suppression diagram of FIG. 1. The inputs may be microphone inputs. The adaptation device 3 can be formed as a Filtered-Sum Beamformer (FSB) then having filter impulse responses $f_1$, $f_2$, . . . $f_M$ or as a Weighted-Sum Beamformer (WSB), which is an FSB whose filters are replaced by real gains $w_1$, $w_2$, . . . $w_M$. These responses and gains beamformer coefficients are continuously subjected to adaptations, that is changes in time. The adaptations can for example be made for focussing on a different speaker location, such as known from EP-A-0954850. Summation, results in a summed output signal of the summing device 4 comprising summed noise of the summed input signals $u_1$, $u_2$, . . . $u_M$, which summed output noise is not stationary. The problem addressed now is how to estimate noise present on individual input signals $u_1$, $U_2$, . . . $u_M$ from summed noise present at the output of the summing device 4, while using the combination of the spectral subtraction of FIG. 1 and the beamformer of FIG. 2.

One could estimate the stationary noise magnitude spectra at the inputs of the adaptive beamformer, and calculate the (non-stationary) noise magnitude spectrum at the summing device output using current beamformer coefficient values. This, however, is costly due to the expensive M spectral transformations required for each beamformer input signal $u_1$, $u_2$, . . . $u_M$.

FIGS. 3*a* and 3*b* show respective noise estimator diagrams to be implemented in the generally programmable audio processor 5 far application in the present multi input audio processing device 2, with and without speech detection respectively. FIG. 4 shows an embodiment of a noise spectrum estimator 6 for application in the respective diagrams of FIGS. 3*a* and 3*b*. It is to be noted that iii this case only one spectral transformation has to be performed, instead of M spectral transformations mentioned above.

If the audio processing device 2 is provided with an audio or speech detector having a switch 7, FIG. 3*a* may be applied. Therein $P_{in}(k;\mathbf{1}_B)$ is a number, which denotes the magnitude of a frequency bin or frequency component k in a subdivided spectral frequency range of the output signal of the summing device 4, and $\mathbf{1}_B$ represents a block or iteration index. Subscript B denotes the data block size, whereby the beamformer frequency coefficients $F_m(k;\mathbf{1}_B)$ (with m=1 . . . M) are updated and changed every B samples. If no speech is detected the speech 7 has the up position in FIG. 3*a* and vice versa. In the up position of the switch 7 an update term $\delta(k;\mathbf{1}_B)$ is fed to the noise spectrum estimator 6 of FIG. 4. The estimator 6 derives an updated estimated noise magnitude summing device 4 output spectrum $\mathbb{P}(k;\mathbf{1}_B)$ therefrom in a way to be explained later. $Z^{-1}$ represents a Z-transform delay element. So it can be derived that if no speech is detected update takes place in accordance with:

$$\mathbb{P}(k;1_B)=NS\{(1-\alpha)[P_{in}(k;1_B)-\mathbb{P}(k;1_{B-1})]\}$$

where α is a memory parameter and NS is a function which represents the behavior of the noise spectrum estimator 6.

FIG. 4 shows an embodiment of the noise spectrum estimator 6 for application in the noise estimator diagrams of FIGS. 3*a* and 3*b* respectively. The estimator 6 has as many branches 1 to M as there are input signals M. The output signals of the branches are added in an adder 8. It holds that:

$$\mathbb{P}(k;1_B)=\sum_{m=1}^{m=M}|F_m(k;1_B)|\mathbb{P}_m(k;1_B)$$

and that:

$$\mathbb{P}_m(k;1_B)=\max[\mathbb{P}_m(k;1_{B-1})+\delta(k;1_B)\mu(k;1_B)|F_m(k;1_B)|,c]$$

for all k, with m=1 . . . M, $\mu(k;\mathbf{1}_B)$ being the adaptation step size. So there are no updates smaller than c (c being a small non-negative constant), and for each input signal $u_m$ a previous estimate of the actual spectrum $\mathbb{P}_m(k;\mathbf{1}_B)$ is being stored in the delay element $Z^{-1}$ for later use thereof. Herewith every branch output signal provides information about the noise characteristics of every individual input signal without excessive frequency transformation calculations being necessary. In the down position of the switch 7, in case speech is being detected the noise spectrum estimator 6 still provides the latest actual noise estimate for noise suppression purposes.

FIG. 3*b* depicts the situation in case no speech detector is present. The embodiment of FIG. 3*b* relies on a recursion, which comes up every $\mathbf{1}_B$ samples and which scheme is repeated for each frequency bin k. In block 9 the signal magnitude spectrum is low-pass filtered, according to:

$$P_s(k;1_B)=\alpha(1_B)\,P_s(k;1_{B-1})+(1-\alpha(1_B))\,P_{in}(k;1_B)$$

For all k. The memory parameter $\alpha(1_B)$ is chosen according to:

$$\alpha(1_B)=\alpha_{up} \text{ if } P_{in}(k;1_B)\geq P_s(k;1_B) \text{ else } \alpha(1_B)=\alpha_{down}$$

Here $\alpha_{up}$ is a constant corresponding to a long memory ($0<<\alpha_{up}<1$) and $\alpha_{down}$ is a constant corresponding to a short memory ($0<\alpha_{down}<<1$). Thus the recursion favors 'going down' above 'going up', so that in effect a minimum is tracked. Generally the step size $\mu(k;\mathbf{1}_B)$ is chosen in the FSB case according to:

$$\mu(k;1_B)=1\Big/\sum_{m=1}^{m=M}|F_m(k;1_B)|^2$$

and in the WSB case such that:

$$\mu(k;1_B)=1\Big/\sum_{m=1}^{m=M}|w_m(k;1_B)|^2$$

which may reduce to $\mu=1$ if certain adaptive algorithms are being used having the property that the denominators of the two above expressions equal 1, such as disclosed in EP-A-0954850. The estimation update term $\delta(k;\mathbf{1}_B)$ is chosen according to: if $P_s(k;\mathbf{1}_B)\geqq \mathfrak{p}(k;\mathbf{1}_{B-1})$ then (condition is true)

$$\delta(k;1_B)=\{q(1_B)-1\}\mathfrak{p}(k;1_{B-1});q(1_B+1)=q(1_B)\times\text{INCFACTOR}$$

else (condition is not true)

$$\delta(k;1_B)=P_s(k;1_B)-\mathfrak{p}(k;1_{B-1});q(1_B+1)=\text{INITVAL}$$

Herein at a sampling rate of 8 KHz with data blocks B=128, one can take INCFACTOR=1.0004 and INITVAL=1.00025. With this mechanism $\mathfrak{p}(k;\mathbf{1}_B)$ is only effectively increased when the measured spectrum $P_s(k;\mathbf{1}_B)$ is larger for a sufficiently long period of time, i.e. in situations wherein the noise has really changed to a larger noise power.

Whilst the above has been described with reference to essentially preferred embodiments and best possible modes it will be understood that these embodiments are by no means to be construed as limiting examples of the devices concerned, because various modifications, features and combination of features falling within the scope of the appended claims are now within reach of the skilled person.

The invention claimed is:

1. A method for noise suppression, wherein noisy input signals in a multiple input audio processing device are subjected to adaptations and summed, wherein noise frequency components of the noisy input signals in the summed input signals are estimated based on individually kept noise frequency components and on said adaptations, wherein each estimated noise frequency component is related to a previous estimate of said noise frequency component and to a correction term which is dependent on the adaptations made on the noisy input signals.

2. The method according to claim 1, wherein the adaptations concern filtering or weighting of the noisy input signals.

3. The method according claim 1 wherein the estimation of the noise frequency components of the respective input signals in the summed input signals can be made dependent on detection of an audio signal in the relevant input signal.

4. The method according to claim 1 wherein the method uses spectral subtraction like techniques to suppress noise.

5. An audio processing device comprising:

multiple inputs for receiving noisy signals;

an adaptation device coupled to the multiple inputs;

a summing device coupled to the adaptation device; and an audio processor, coupled to the adaptation device and the summing device to estimate individual noise frequency components of the noisy signals received on the multiple inputs, wherein each estimated noise frequency component is related to a previous estimate of said noise frequency component and to a correction term which is dependent on the adaptations made on the noisy input signals.

6. The audio processing device according to claim 5, wherein the audio processing device comprises an audio detector, coupled to the audio processor.

7. A communication device having an audio processing device, the audio processing device comprising:

multiple inputs for receiving signals containing a noise component, an adaptation device coupled to the multiple inputs, a summing device coupled to the adaptation device and an audio processor, wherein the audio processor, which is coupled to the adaptation device and the summing device, is equipped to estimate individual noise frequency components of the multiple input signals, wherein each estimated noise frequency component is related to a previous estimate of said noise frequency component and to a correction term which is dependent on the adaptations made on the noisy input signals.

* * * * *